US006688133B1

(12) United States Patent
Donefrio

(10) Patent No.: US 6,688,133 B1
(45) Date of Patent: Feb. 10, 2004

(54) COOLING CONTAINER INCLUDING A BUILT IN DRAIN

(76) Inventor: Edward Donefrio, 10650 Park Place Dr., Largo, FL (US) 33771

( * ) Notice: Subject to any disclaimer, the term of this patent is extended or adjusted under 35 U.S.C. 154(b) by 0 days.

(21) Appl. No.: 10/408,039

(22) Filed: Apr. 7, 2003

(51) Int. Cl.[7] ..... F25D 3/08
(52) U.S. Cl. ..... 62/372; 62/457.2
(58) Field of Search ..... 62/458, 457.2, 62/371, 372, 464, 462

(56) References Cited

U.S. PATENT DOCUMENTS

| | | | | |
|---|---|---|---|---|
| 216,635 | A | | 6/1879 | Warner |
| 909,252 | A | | 1/1909 | Straub et al. |
| 958,931 | A | | 5/1910 | Kersey |
| 1,906,815 | A | | 5/1933 | Schlumbohn |
| 2,810,276 | A | | 10/1957 | Murray |
| 4,724,682 | A | * | 2/1988 | Flum et al. ..... 62/462 |
| 4,989,419 | A | | 2/1991 | Brando et al. |
| 5,024,065 | A | * | 6/1991 | Barrett ..... 62/285 |
| 5,048,171 | A | * | 9/1991 | Bidwell et al. ..... 29/401.1 |
| 5,226,296 | A | * | 7/1993 | Kolvites et al. ..... 62/390 |
| 5,345,784 | A | | 9/1994 | Bazemore et al. |
| 5,372,274 | A | | 12/1994 | Freedland |
| 5,596,880 | A | | 1/1997 | Welker et al. |
| 5,718,124 | A | | 2/1998 | Senecal |
| 6,370,885 | B1 | * | 4/2002 | Jennings et al. ..... 62/56 |
| 6,415,623 | B1 | * | 7/2002 | Jennings et al. ..... 62/457.2 |
| 6,453,682 | B1 | * | 9/2002 | Jennings et al. ..... 62/56 |

* cited by examiner

*Primary Examiner*—Melvin Jones
(74) *Attorney, Agent, or Firm*—Harold D. Shall

(57) ABSTRACT

A cooling container assembly including a cooling tub resting on a supporting base. The cooling tub has a central drain opening with a hose depending therefrom and passing through an opening in the top surface of the supporting base and extending into a drain receptacle in the supporting base; the latter having a doored opening through which the drain receptacle can be inserted and removed.

3 Claims, 2 Drawing Sheets

COOLING CONTAINER INCLUDING A BUILT IN DRAIN

BACKGROUND OF THE INVENTION

1) Field of the Invention

This invention relate to containers for cooling and presenting bottles and cans of soda, beer, other beverages and the like and more particularly to such containers which utilize melting ice as the cooling media and include a built in drain for the liquid resulting from the melted ice.

2) Description of the Prior Art

Cooling containers, such as seen in U.S. Pat. No. 5,596,880, are known in the art, but must be disposed adjacent to a drain so the drain hose 22 thereof can drain the container. Likewise in U.S. Pat. No. 958,931, drain hose "g" must be disposed lose to a drain. In either case, if a drain is not close, the entire cooling device must be moved to the vicinity of a drain so that the drain hose can reach it.

SUMMARY OF THE INVENTION

The present invention solves the draining problem by providing a cooling container, for containing ice and containers of cooled beverages, with a supporting base, with the latter having a "doored" opening therein for receiving an easily removable drain receptacle. The bottom of the cooling container has a medially located drain opening therein which connects to a drain hose, with the latter extending to and emptying into the drain receptacle. When it is desired to empty the drain receptacle, the door in the supporting base is opened to access the receptacle, and the latter removed to be dumped in a drain without having to move the entire setup to the vicinity of the drain.

DETAILED DESCRIPTION OF THE PREFERRED EMBODIMENT

Figure 1:
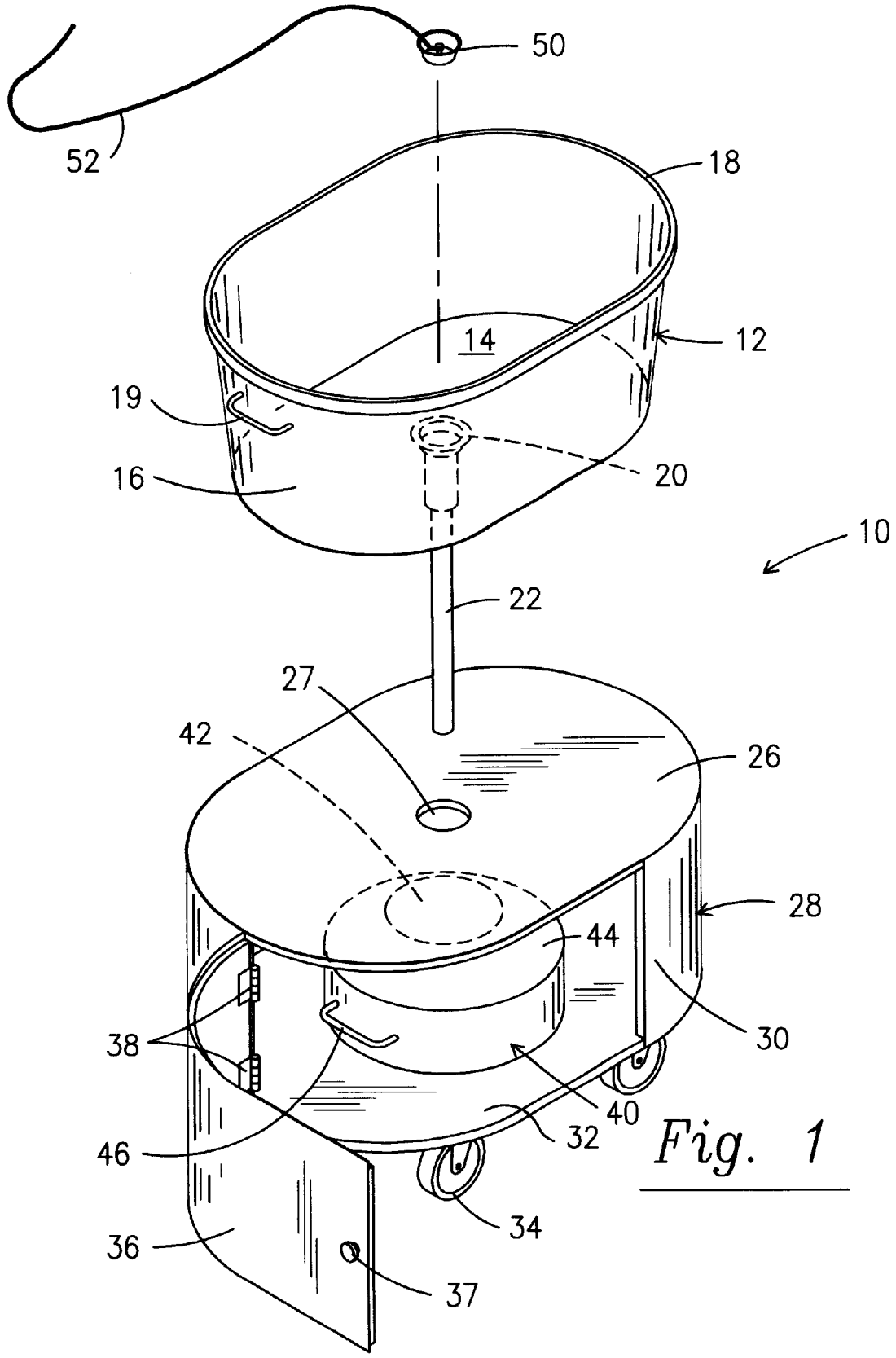
FIG. 1 is an exploded perspective view of this invention.
Figure 2:
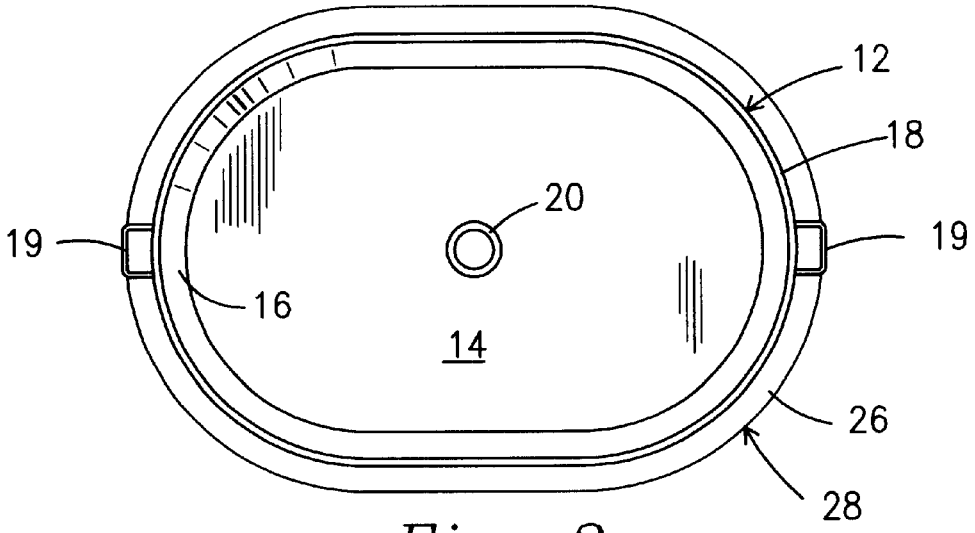
FIG. 2 is a plan view of the device of FIG. 1.
Figure 3:
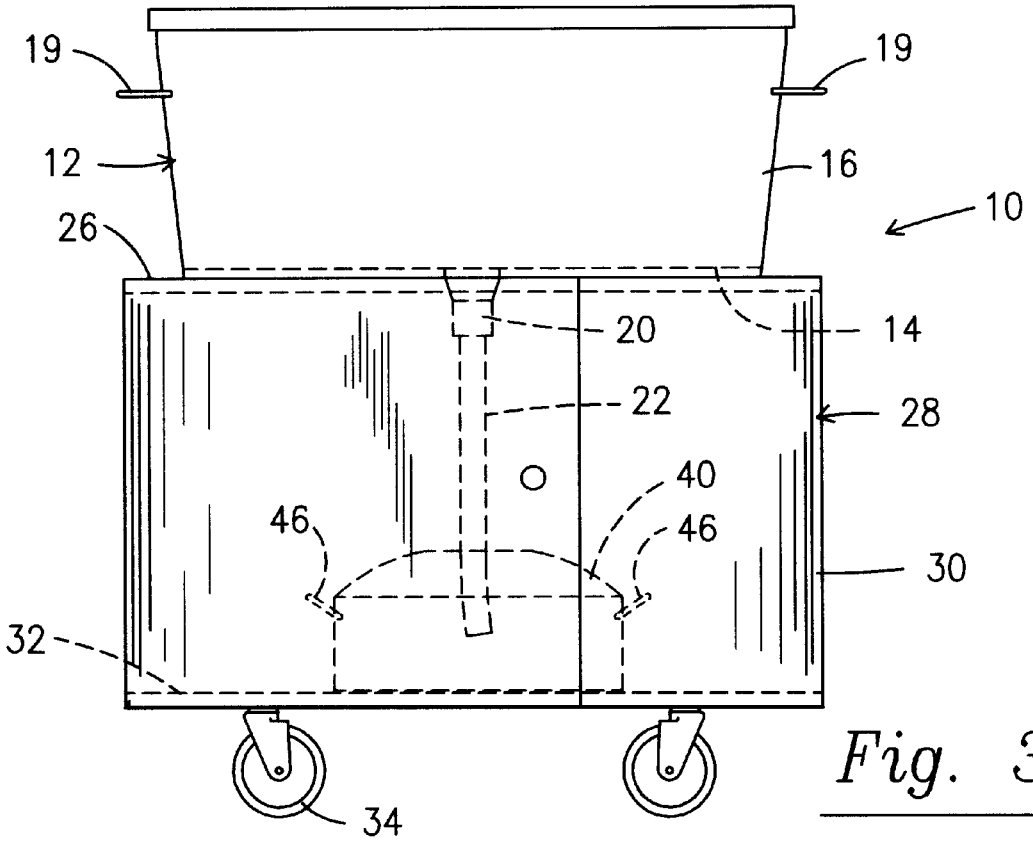
FIG. 3 is a front elevational view of the device of FIG. 1.

A cooling container assembly is shown generally at 10 and includes a cooling tub 12 having a bottom 14 with an integral peripheral wall 16 having an overturned and smooth upper lip 18. The wall 16 has securely mounted thereon a pair of opposed handles 19 which are provided for grasping at such time as it is desired to move the cooling tub 12. Medially located in the bottom 14 is a drain fitting 20, which extends downwardly and mounts thereon a downwardly extending drain hose 22. The tub is made of sturdy material to insure that it can coolingly contain and support a plurality of beverage containers along with a supply of ice and the resulting melted ice water.

The bottom 14 of the tub 12 rests upon and is supported by the top wall 26 of a supporting base shown generally at 28. The top wall 26 is supportingly connected to a side wall 30, which in turn is connected to a bottom wall 32; the latter mounting on the bottom thereof a plurality of ground engaging castors 34 which provide for the easy movement of the container assembly 10 to its desired location. The side wall 30 may bear various indicia thereon such as "Happy Birthday", etc., either directly or by securing a placard thereon and includes a door 36 connected to the adjoining portion of the wall by a pair of hinges 38, which door has a handle 37 and can be opened to access the interior of the supporting base 28, wherein there is disposed a drain receptacle 40 which is resting on and supported by the bottom wall 32 of the base 28. The receptacle 40 is of the non splash variety and has a central opening 42 in the top 44 thereof and the drain hose 22 extends downwardly thereinto, whereby water from the melted ice from the tub 12 can drain into the receptacle through the hose 22, the latter reaching the receptacle after passing through an opening 27 in the top wall 26 of the supporting base 28. The central opening 42 in the receptacle 40 is smaller in diameter than the diameter of the top 44 of the receptacle to give the receptacle its non splash characteristics. The receptacle 40 has a pair of opposed handles 46 whereby the container can be grasped by the operator to remove the container from the confines of the base 28 through the open door 36 and carried to a drain and dumped. The drain opening 20 can be allowed to remain open to constantly drain the tub 12, however, as many operators desire that a quantity of water be allowed to remain in the tub along with the ice contained therein to coolingly bathe the beverage containers in the tub, a drain plug 50 adapted to be fittingly received in the drain opening 20 is proved to close the drain until such time as the operator desires to pull the plug and drain the tub. The plug 50 can be provided with a pull chain 52 so that it can be pulled without the operator having to place his arm into the cold ice water.

While only a single embodiment of this invention has been shown and described, it is understood that changes can be made therein without departing from the scope of this invention as claimed.

What is claimed is:

1. A cooling container assembly comprising in combination,

A) a cooling tub having a peripheral wall and a tub bottom wall and having a closable opening in said tub bottom wall thereof with said closable opening including a closing member for selectively opening and closing said closable opening, B) a supporting base having a top wall, a side wall and a bottom wall, with said side wall having a doored opening therein, and said bottom wall having a plurality of castors thereon and said top wall having a central opening therein, C) a drain receptacle adapted for positioning within said supporting base through said doored opening and below said closable opening and alternatively being removed from said supporting base through said doored opening for emptying, and D) a drain hose connected to said closable opening in said bottom wall and extending through said central opening in said top wall and into said drain receptacle for draining said cooling tub into said receptacle at such time as said closing member has opened said closable opening.

2. An assembly according to claim 1 wherein said receptacle has a pair of opposed graspable handles thereon.

3. An assembly according to claim 2 wherein said receptacle has an upper surface having a central opening smaller in diameter than the diameter of said upper surface whereby said receptacle is splash proof.

* * * * *